United States Patent [19]

Gerhard

[11] Patent Number: 4,941,583

[45] Date of Patent: Jul. 17, 1990

[54] PRESSURE TANK

[75] Inventor: Helmut Gerhard, Weitefeld, Fed. Rep. of Germany

[73] Assignee: Westerwaelder Eisenwerk Gerhard GmbH, Fed. Rep. of Germany

[21] Appl. No.: 459,960

[22] Filed: Jan. 2, 1990

[30] Foreign Application Priority Data

Feb. 1, 1989 [DE] Fed. Rep. of Germany ... 8901105[U]

[51] Int. Cl.[5] ..... B65D 88/06

[52] U.S. Cl. ..... 220/5 A; 220/1 B; 220/83

[58] Field of Search ..... 220/1 B, 5 A, 3, 83, 220/75

[56] References Cited

U.S. PATENT DOCUMENTS

| | | | |
|---|---|---|---|
| 2,380,089 | 7/1945 | Ulm | 220/1 B |
| 2,598,160 | 5/1952 | Gruenais | 220/1 B |
| 2,818,191 | 12/1957 | Arne | 220/1 B |
| 3,314,567 | 4/1967 | Becker et al. | 220/5 A |
| 3,661,293 | 5/1972 | Gerhard et al. | 220/83 X |
| 3,814,290 | 6/1974 | Gerhard | 220/5 A X |
| 3,912,103 | 10/1975 | Gerhard | 220/83 X |
| 4,356,925 | 11/1982 | Gerhard | 220/3 X |
| 4,840,282 | 6/1989 | Gerhard | 220/5 A X |
| 4,854,462 | 8/1989 | Gerhard | 220/5 A |

*Primary Examiner*—Steven M. Pollard

*Attorney, Agent, or Firm*—Evenson, Wands, Edwards, Lenahan & McKeown

[57] ABSTRACT

With due consideration of the cross-sectional dimensions available in ISO containers and of the cold-rolling widths that can be achieved, a pressure-resistant tank may be constructed from two casing portions (10, 11) each prefabricated from two longitudinally welded cold-rolled plates, a bottom tubular longitudinal member (12) and a trough-shaped top longitudinal member (13). The two longitudinal members (12, 13) are interconnected by means of tie rods (14). The top longitudinal member (13) comprises a top shell (15) projecting into the interior of the tank, a tension plate (18) interconnecting the upper edges of the top shell (15), and a section member (19) fitted inbetween the top shell (15) and the plate (18). The relatively wide top shell (15), which is required on account of the aforementioned dimensional reasons, is also used to accommodate the manhole (23) and other tank fittings and forms a spill-over trough therefor, which can be emptied downwards through one of the tubular tie rods (14).

10 Claims, 2 Drawing Sheets

PRESSURE TANK

BACKGROUND OF THE INVENTION

This invention relates to a pressure-resistant tank having a casing composed of part-cylindrical casing portions with parallel longitudinal axes fitted between hollow longitudinal members, wherein opposite longitudinal members are interconnected by tie rods extending vertically through the tank interior.

U.S. Pat. No. 4,840,282 discloses a pressure-resistant tank of this type, which is configured as a tank container. There, the tank casing has a substantially cloverleaf shaped cross-section formed by four part-cylindrical casing portions which are fitted between four tubular longitudinal members.

Based on the current ISO container standards, the known configuration results in a circumferential length of the individual casing portions which does not exceed the maximum possible rolling width of about 2 m. Welds are therefore necessary only between the casing portions and the tubular longitudinal members while they are not required within the casing portions themselves.

However, the specified rolling width of about 2 m can only be achieved by "surface cold rolling" of an initially hot-rolled sheet material. With the rolling technique presently available in Europe, cold-rolled coils produced continuously from wide strip material can be obtained up to a width of about 1.6 m. If it is attempted to build dual-shell tanks in accordance with the principle known from U.S. Pat. No. 4,840,282 it will be apparent that the two casing portions require circumferential dimensions which are substantially in excess of the above-specified rolling width, if the ISO framework profile is to be fully utilized.

By longitudinally joining two cold-rolled sheets each having a width of about 1.6 m, a dimension in the circumferential direction of at most about 3.2 m can be obtained for a casing portion provided with one weld. In view of the desired utilization, of the ISO profile this dimension is still insufficient for building a dual-shell tank.

SUMMARY OF THE INVENTION

It is an object of the invention to provide a pressure-resistant tank the casing of which is composed of a minimum number of parts while optimally utilizing the available cross-section of ISO containers and the available width of cold rolled material.

This object is met in accordance with the present invention by pressure-resistant tank having a casing composed of part-cylindrical casing portions with parallel longitudinal axes fitted between hollow longitudinal members, opposite longitudinal members being interconnected by tie rods which extend vertically through the tank interior, wherein the tank casing is formed by only two casing portions fitted between top and bottom longitudinal members and wherein the top longitudinal member is composed of a top shell which is curved transverse to the longitudinal direction and projects into the tank interior, and of a tension plate interconnecting the upper ends of the top shell.

Accordingly, the tank casing comprises only two longitudinal members and two casing portions. The top shell used for the top longitudinal member may be circumferentially dimensioned so as to complete the circumferential dimension of the two casing portions, each of which may be prefabricated from two cold-rolled sheets to the size required for optimum utilization of the available profile. As said top shell is also curved, it provides substantially the same resistance to internal pressure as the tank casing portions. Simultaneously, the shape of the top shell, which projects into the tank interior, provides a protected space for the recessed accommodation of manhole members and tank fittings. Thus, the width of the top longitudinal member created by the top shell, which width is greater than that of a normal tubular member, is appropriately utilized.

Preferably, a section member is fitted between the tension plate and the top shell. This tension plate not only provides a cover for the fittings mounted in the top shell but also further increases the tank strength. The upper surface of said tension plate may conveniently be provided with projections to constitute a non-skid operator's catwalk.

In further advantageous developments of the invention, the tension plate may be constituted by upper flanges of said top shell, which flanges may be joined to said section member. The section member, which may be constituted by an I- or T-beam having a vertical web, may be recessed in a manhole area and welded to an outer tubular manhole flange. The tie rod may be welded to the bottom flange and web of said beam, the bottom flange being recessed to conform to the cross section of said tie rod. Further, the section member may be a rectangular tube with a perpendicularly extending cross-section diagonal. Alternatively, the cross-section of said top shell may be gusset-shaped with its two wall portions having a curvature to conform to said tank casing portions. All these measures are beneficial from the standpoint of manufacture, utilization of material, and strength of the tank.

In another advantageous embodiment the top shell is used as a spill-over trough encompassing the manhole and the tank fittings. This trough may be provided with an overflow member formed by at least one tie rod being hollow with openings at its top and bottom ends and communicating with the interior of said top shell.

DETAILED DESCRIPTION OF PREFERRED EMBODIMENTS

Figure 1:
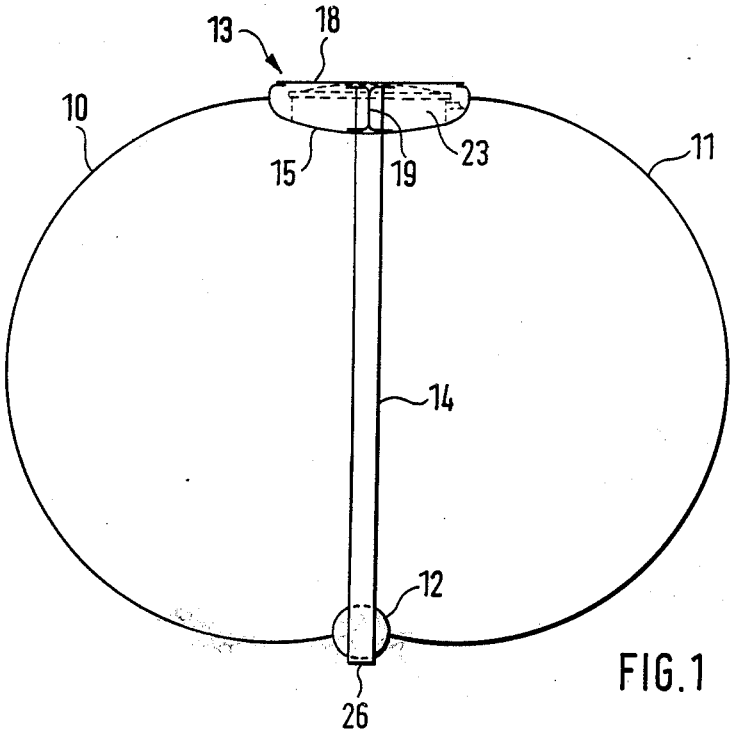
FIG. 1 is a sectional view of a pressure-resistant tank.

The casing of the tank illustrated in FIG. 1 is substantially composed of two part-circular cylindrical casing portions 10, 11 having parallel longitudinal axes. The bottom longitudinal edges of the casing portions 10, 11 are welded to a tubular bottom longitudinal member 12 while their top longitudinal edges are welded to a somewhat trough-shaped top longitudinal member 13. Depending on the tank length, the two longitudinal members 12, 13 are interconnected by one or more tubular tie rods 14.

The maximum width of the tank cross-section illustrated in FIG. 1 is 2460 mm and the maximum height is 1943 mm. In this case, when the tubular bottom longitudinal member 12 has a diameter of about 100 mm and the top longitudinal member 13 has a width of about 700 mm, each casing portion 10 and 11 will have a circumferential length of less than 3200 mm. A casing portion of dimension can be formed of a sheet which is prefabricated from two cold-rolled strips joined by a longitudinal weld. As a result, the tank casing according to FIG. 1 in its circumferential direction requires a total of only six welds extending in the longitudinal direction of the tank, and of these six welds only four have to be produced while the tank is actually assembled.

Figure 2:
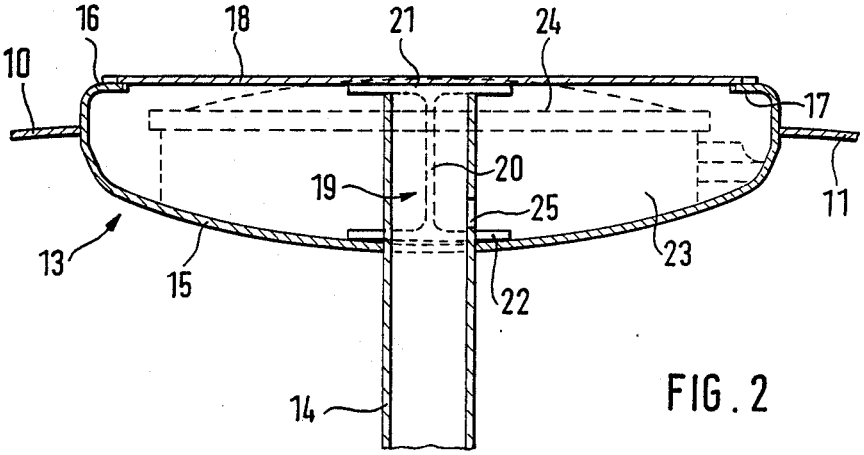
FIG. 2 is an enlarged side view illustrating the top area of the tank of FIG. 1.

As will be apparent in detail from FIG. 2, the top longitudinal member 13 comprises a top shell 15 which is convexly curved toward the tank interior and the upper ends of which constitute flanges 16, 17 bent towards each other. A flat tension plate 18 has its longitudinal edges bolted or welded to the two flanges 16, 17, and a profile element is fitted inbetween the top shell 15 and the plate 18. In the embodiment shown in FIG. 2, the profile element is constituted by a wide-flanged I-beam 19 including a vertical web 20, a top flange 21 and a bottom flange 22.

The tie rod 14 may be connected to the bottom longitudinal member 12 in the way described in U.S. Pat. No. 4,840,282. In the vicinity of the upper end of the tie rod 14, the top shell 15 and the bottom flange 22 of the I-beam 19 are recessed corresponding to the tie rod cross-section. The tie rod 14 is provided with a vertical slot corresponding to the thickness of the web 20 of the I-beam 19, the length of said slot being dimensioned such that the tie rod 14 reaches right to the top flange 21. The tie rod 14 is welded to the I-beam 19 in the vicinity of the mentioned slot and also of the recess in the bottom flange 22.

As indicated in dashed lines in FIG. 2, the top shell 15 is penetrated by a manhole flange 23 and tank fittings (not illustrated), these elements being welded to the top shell 15 and the I-beam 19 which latter is recessed in these areas. The manhole flange 23 including a manhole cover 24 and the other tank fittings are disposed completely within the space defined by the top shell 15 and the plate 18.

The top shell 15 has the function of a spill-over trough and to this end may be subdivided into a plurality of compartments by partition webs extending transverse to the longitudinal axis. As will be apparent from FIG. 2, the hollow tie rod 14, at a location slightly above the top shell 15, is formed with a port 25 in its tubular wall through which port any liquid entering the spill-over trough may enter the tie rod 14 to be discharged from the open bottom end 26 thereof (FIG. 1). The bottom flange 22 of the I-beam 19 is welded with its two longitudinal edges to the inner surface of the top shell 15 at least within the area of said spill-over trough.

Figure 3:
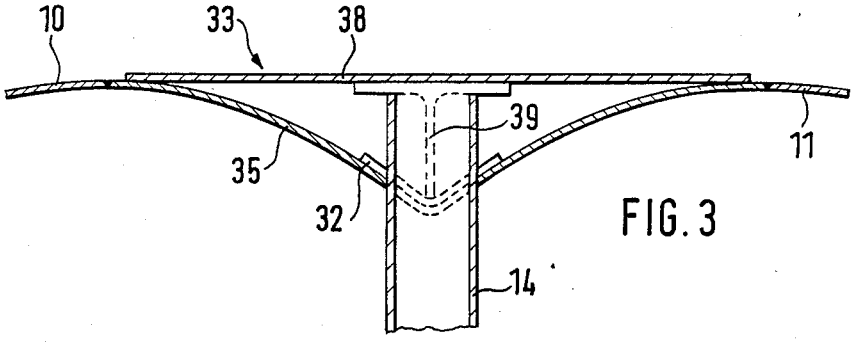
FIGS. 3 to 6 are further embodiments of the top area of the tank similar to FIG. 2.

The top longitudinal member 33 shown in FIG. 3 differs from the longitudinal member 13 of FIG. 2 in that the top shell 35 is substantially gusset-shaped and, in contrast to FIG. 2, is concavely shaped towards the tank interior, its two wall portions being curved so as to form continuations of the casing portions 10, 11. Furthermore, the beam, which has an overall cross-sectional shape similar to an I-beam, is composed of a T-beam 39 and an L-member 32 shaped to conform to the gusset region of the top shell 35. The side edges of the top shell 35 are butt-welded to the upper side edges of the casing portions 10, 11.

Figure 4:
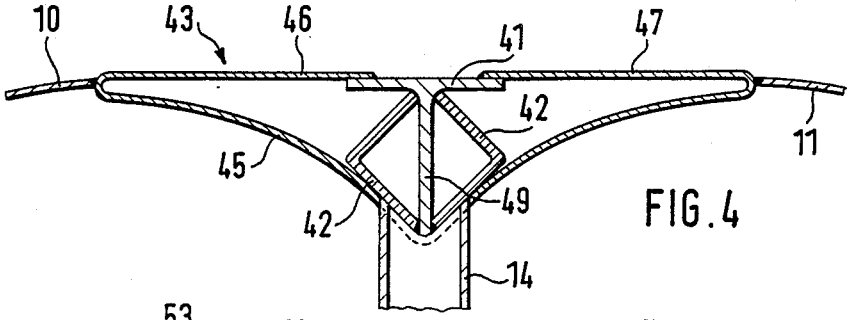

In the configuration of the top longitudinal member 43 illustrated in FIG. 4, the top shell 45 in the vicinity of its weld joints with the casing portions 10, 11 is bent inwardly, and the thus formed flanges 46, 47 are lap-welded to the top flange 41 of a T-beam 49, which is similar to that used in FIG. 3. In this case, there is no separate tension plate like that indicated at 38 in FIG. 3. Furthermore, in the embodiment of FIG. 4, the L-member 32 of FIG. 3 has been replaced by two L-bars 42 each of which has the outer edge of one leg welded to the lower web of the T-beam 49 and that of the other leg engaging in the corner area between web and flange of the T-beam 49.

Figure 5:
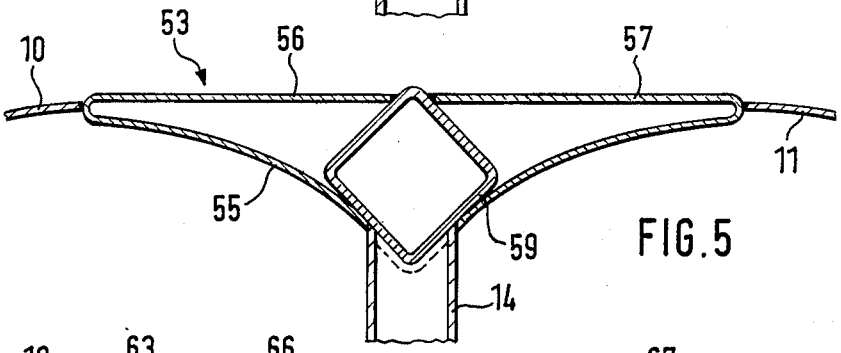

The top longitudinal member 53 of FIG. 5 differs from that of FIG. 4 in that the section member is a rectangular tube 59 the cross-sectional diagonals of which extend vertically and horizontally. In this case the flanges 56 and 57 of the top shell 55 are welded to the rectangular tube 59 near the vertex thereof.

Figure 6:
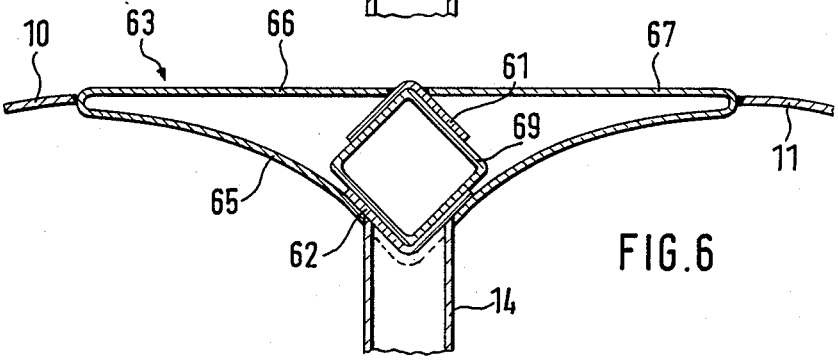

In the embodiment illustrated in FIG. 6, a rectangular tube 69 is fitted between top and bottom L-bars 61 and 62 of which the bottom one (62) rests in the gusset area of a top shell 65 while the top one (61) has the flanges 66, 67 of the top shell 65 welded thereto.

Provided a separate tension plate 18, 38 as illustrated in FIG. 2 or FIG. 3 is present, the upper face thereof may be formed with upwardly projecting fluted, diamond-shaped or point-like formations and may be used as a non-skid catwalk. Similar non-skid measures may be provided on the upper surfaces of the flanges 46, 47; 56, 57; and 66, 67 of the top shell 45; 55; and 65 as shown in FIGS. 4 to 6, respectively.

What is claimed is:

1. A pressure-resistant tank having a casing composed of part-cylindrical casing portions with parallel longitudinal axes fitted between hollow longitudinal members, opposite longitudinal members being interconnected by tie rods which extend vertically through the tank interior, wherein the tank casing is formed by only two casing portions fitted between top and bottom longitudinal members, said top longitudinal member being composed of a top shell which is curved transverse to the longitudinal direction and projects into the tank interior, and of a tension plate interconnecting the upper ends of the top shell.

2. The tank of claim 1, wherein a section member is fitted between said tension plate and top shell.

3. The tank of claim 1, wherein the upper surface of said tension plate is provided with projections to constitute a non-skid catwalk.

4. The tank of claim 1, wherein said tension plate is constituted by upper flanges of said top shell, said flanges being joined to said section member.

5. The tank of claim 1, wherein said section member is recessed in a manhole area and welded to an outer tubular manhole flange.

6. The tank of claim 5, wherein at least one tie rod is hollow with openings at its top and bottom ends and is in communication with the interior of said top shell.

7. The tank of claim 1, wherein said section member is an I- or T-beam having a vertical web.

8. The tank of claim 7, wherein said tie rod is welded to the bottom flange and web of said beam, said bottom flange being recessed to conform to the cross-section of said tie rod.

9. The tank of claim 1, wherein said section member is a rectangular tube with a perpendicularly extending cross-section diagonal.

10. The tank of claim 1, wherein the cross-section of said top shell is gusset-shaped with its two wall portions having a curvature to conform to said tank casing portions.

* * * * *